US008590698B1

(12) United States Patent
Osborne

(10) Patent No.: US 8,590,698 B1
(45) Date of Patent: Nov. 26, 2013

(54) EYEWEAR STORAGE CASES AND RELATED METHODS

(76) Inventor: David W. Osborne, Cedar Hills, UT (US)

( * ) Notice: Subject to any disclaimer, the term of this patent is extended or adjusted under 35 U.S.C. 154(b) by 231 days.

(21) Appl. No.: 13/099,111

(22) Filed: May 2, 2011

Related U.S. Application Data

(63) Continuation-in-part of application No. 29/353,401, filed on Jan. 7, 2010, now abandoned.

(60) Provisional application No. 61/430,817, filed on Jan. 7, 2011.

(51) Int. Cl.
*A45C 11/04* (2006.01)

(52) U.S. Cl.
USPC ..... 206/5; 206/38

(58) Field of Classification Search
USPC ..... 206/5, 37, 38, 216, 234; 351/158; 383/4, 36
See application file for complete search history.

(56) References Cited

U.S. PATENT DOCUMENTS

| | | | | |
|---|---|---|---|---|
| D197,736 | S | | 3/1964 | Tawil |
| D208,586 | S | | 9/1967 | Gindi |
| D286,462 | S | | 11/1986 | Sender et al. |
| D299,683 | S | | 2/1989 | Marks |
| 4,823,943 | A | | 4/1989 | Chang |
| D301,085 | S | | 5/1989 | Marks |
| D308,752 | S | | 6/1990 | Hall |
| D333,561 | S | | 3/1993 | Paulenco |
| 5,244,278 | A | * | 9/1993 | Robitaille ..... 383/4 |
| 5,251,743 | A | * | 10/1993 | Pulido et al. ..... 206/38.1 |
| 5,454,643 | A | * | 10/1995 | Sullivan ..... 383/4 |
| D366,758 | S | | 2/1996 | Weiler |
| 5,490,619 | A | * | 2/1996 | Boyar ..... 383/4 |
| 6,129,452 | A | * | 10/2000 | Hakulin ..... 383/4 |
| D449,927 | S | | 11/2001 | Dorizas |
| 6,393,637 | B1 | * | 5/2002 | Hoffman ..... 5/413 R |
| 6,581,760 | B1 | * | 6/2003 | Robertson ..... 206/5 |
| 6,634,041 | B2 | * | 10/2003 | Higashi et al. ..... 383/4 |
| 6,923,313 | B1 | * | 8/2005 | Orogun-Thomas ..... 206/5 |
| 6,952,845 | B1 | * | 10/2005 | Akkad ..... 383/4 |
| 7,058,997 | B1 | * | 6/2006 | Klinger ..... 383/4 |
| D600,911 | S | | 9/2009 | Orion et al. |
| D611,708 | S | | 3/2010 | Alexander |
| D617,555 | S | | 6/2010 | Westphal |

* cited by examiner

*Primary Examiner* — Luan K Bui
(74) *Attorney, Agent, or Firm* — Thorpe North & Western LLP

(57) ABSTRACT

Eyewear cases and collapsible storage cases for use in storing and polishing or cleaning eyewear or other objects with a scratch sensitive surface are disclosed and described. In some embodiments such a case may include a soft and flexible bag having an opening and an internal space sufficiently sized to receive and store a piece of eyewear or other object, and a soft and flexible cover attached to the bag and providing an enclosure with an opening and cavity sufficiently sized to receive and store the bag when the bag is empty. In practice the bag extends out of the cavity through the cover opening for use in either storing, cleaning, or treating eyewear or other object, and retracts back through the cover opening and substantially into the cavity when not in use for storage.

18 Claims, 11 Drawing Sheets

EYEWEAR STORAGE CASES AND RELATED METHODS

PRIORITY DATA

This application claims the benefit of U.S. Provisional Patent Application Ser. No. 61/430,817, filed on Jan. 7, 2011, and is also a continuation-in-part of U.S. patent application Ser. No. 29/353,401, filed on Jan. 7, 2010, now abandoned, each of which is incorporated herein by reference.

FIELD OF THE INVENTION

The present invention relates generally to devices and methods for using, storing, and caring for eyewear or other items, particularly items with scratch sensitive features or surfaces. Accordingly, the present invention involves the mechanical and material science fields.

BACKGROUND OF THE INVENTION

The use of eyewear such as prescription eyeglasses, sunglasses, safety glasses, swimming goggles, 3D glasses, or other eyewear has become a part of everyday life for many people. Such eyewear is typically worn under desirable or required conditions, and then removed from a user's face when no longer needed. One example is that those living an active lifestyle may utilize sunglasses when engaged in an outdoor activity, such as running, biking, hiking, or skiing, and then wish to remove and store the sunglasses during a break from the activity, or when the activity is complete. Often, users find it convenient to store sunglasses or other eyewear about their person, but are reluctant to carry a suitable storage case with them due to the inconvenient size of most cases. As a result, the user's eyewear ends up placed in a pocket, on the top of the user's head, hanging from the front of the user's shirt, or elsewhere.

In addition, most eyewear requires frequent maintenance in order to allow for peak performance and in order to lengthen the life of the eyewear. The primary maintenance required is that of cleaning the lenses of the eyewear in order to assure that vision there through remains clear. However, due to the inconvenience of carrying a suitable cleaning cloth, most users end up cleaning their eyewear with less than desirable articles, such as the user's shirt or sleeve, and run the risk of scratching or otherwise damaging the eyewear.

SUMMARY OF THE INVENTION

Accordingly, the present invention provides collapsible storage cases that may be used to store a piece of eyewear, or other suitably sized objects, and may optionally be fabricated out of materials that allow the cases to serve the dual purpose of further being used in cleaning or treating eyewear, or any other device with a scratch sensitive surface, such as personal electronics. In one aspect, such a collapsible case may include a soft and flexible bag having an opening and an internal space sufficiently sized, or appropriately sized, to receive and store a piece of eyewear, and a soft and flexible cover attached to the bag and providing an enclosure with an opening and cavity sufficiently sized, or appropriately sized, to receive and store the bag when the bag is empty. In operation, the bag extends out of the cavity through the cover opening for use and retracts back through the cover opening and substantially into the cavity for storage.

In another aspect of the present invention, a collapsible case, such as an eyewear case, may include a bag of a first material having an opening and an internal space sufficiently sized to receive and store a piece of eyewear, and a cover of a second material different from the first material of the bag. The cover is typically attached to the bag and provides an enclosure with an opening and cavity sufficiently sized to receive and store the bag when the bag is empty. In operation, the bag extends out of the cavity through the cover opening for use and retracts back through the cover opening and substantially into the cavity for storage.

The present invention further encompasses methods for storing eyewear or other objects, and methods of cleaning or treating eyewear or other objects, as well as associate methods of using the collapsible cases of the present invention. In one embodiment, a method for cleaning or treating a device with a scratch sensitive surface, including a piece of eyewear, may include providing a case having a cover attached to a bag as recited herein, extending the bag out of the cover, and engaging the bag against the eyewear or other device to clean or treat the eyewear or other device. In another embodiment, a method for storing eyewear or other objects may include providing a case having a cover attached to a bag as recited herein, extending the bag out of the cover, and inserting the eyewear or other objects through an opening in the bag. Eyewear and other objects may then be retrieved back through the opening of the bag when desired, and the bag may be retracted back within the cover for storage until use of the bag is again desired. Further, when using the bag to clean or treat eyewear or another object with a scratch sensitive surface, the bag may be stored within the cover as described herein once use of the bag is complete.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

Figure 1:
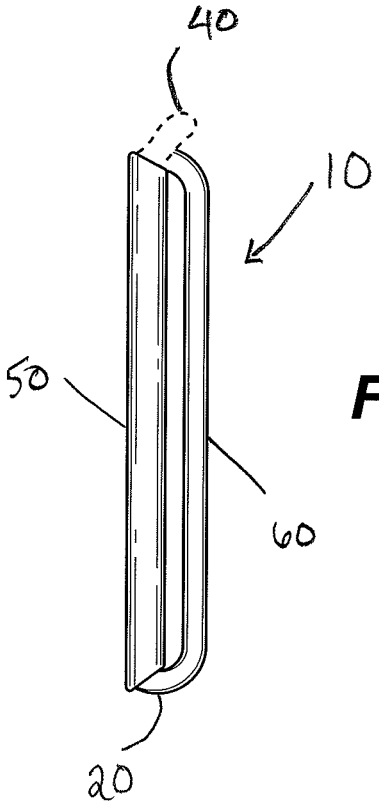
FIG. 1 is a top view of an eyewear case having a soft and flexible bag attached to a cover, the cover having a bottom flap in an open position and a top flap in a closed position and the bag extended out of the cover for use in accordance with one embodiment of the present invention.

In describing and claiming the present invention, the following terminology will be used in accordance with the definitions set forth below.

The singular forms "a," "an," and, "the" include plural referents unless the context clearly dictates otherwise. Thus, for example, reference to "a particle" includes reference to one or more of such particles, and reference to "the resin" includes reference to one or more of such resins.

As used herein the phrase "appropriately sized to receive," used in connection with an object to be received into a cover, case, bag, pouch, or other container refers to the size and/or shape of the cover, case, bag, pouch, or other container allowing receipt of the object in a way that does not leave a significant amount of excess room in the cover, case, bag, pouch, or other container once the object has been placed therein. For example, a bag that is "appropriately sized to receive" a piece of eyewear would have the size and/or shape of a container deemed generally suitable for use as an eyewear case and nothing more. Other covers, cases, bags, pouches, or containers of a larger size, such as a gym bag, purse, or back pack, though large enough to insert a piece of eyewear are excluded from such a phrase because of the excess space left over once the eyewear has been inserted. Therefore, such a phrase as used herein can be an approximate descriptor of the size and/or shape of a cover, case, bag, pouch, or container based on the item to be placed and/or stored therein, including without limitation, eyewear (including glasses, sunglasses, goggles, safety glasses, etc.), personal electronics such as music players, cameras, tablet computers, cell phones, hand held gaming devices, computer memory or storage devices, or nearly any other object.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

THE INVENTION

The present invention provides storage cases, including eyewear cases, and methods for the use thereof. Generally speaking, the storage cases, have a bag with an opening and an internal space sufficiently sized to receive and store a piece of eyewear, or other desired object, and a cover attached to the bag which provides an enclosure with an opening and a cavity sufficiently sized to received and store the bag when the bag is empty. In operation, the bag can be collapsed and retracted into the cover for storage when the bag is empty. The bag can then be extended out of the opening of the cover for use to receive and hold a piece of eyewear or other desired object. In some aspects, depending on the material of the bag, the bag may be employed in other uses in addition to holding and storing eyewear or another suitable object, such as cleaning or treating a scratch sensitive surface.

In some aspects, the scratch sensitive surface may be on a piece of eyewear, such as the lenses or frame of glasses, sunglasses, safety glasses, goggles including ski goggles and swim goggles, etc. Further, nearly any other scratch sensitive surface can be cleaned or treated with the bag, when the bag, or at least a portion thereof, is made of suitable material, such as a soft cloth, for example microfiber. Examples of additional items with scratch sensitive surfaces include without limitation: optical disks, wooden items, items with a glossy or coated surface, electronic equipment, including hand held or portable electronic equipment, such as electronic gaming devices, electronic music and video players, DVD and CD players, tablet computers, cell phones, laptop computers, cameras, video cameras, camera lenses, etc. Moreover, such items may be held and stored in the bag when the storage case of the present invention is suitably sized.

Figure 2:
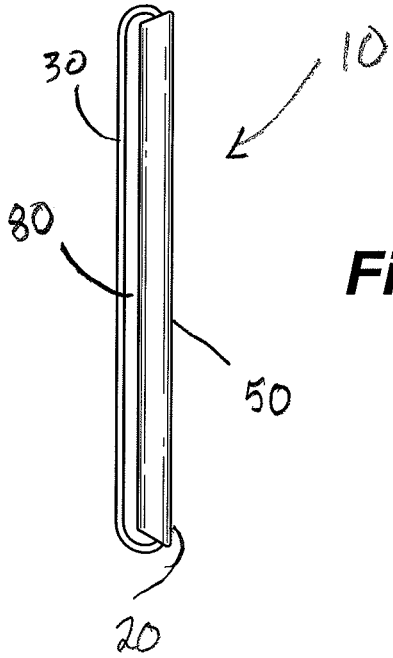
FIG. 2 is a top view of an eyewear case having a soft and flexible bag attached to a cover, the cover having a bottom flap in an open position and a top flap also in an open position and the bag extended out of the cover for use in accordance with one embodiment of the present invention.
Figure 3:
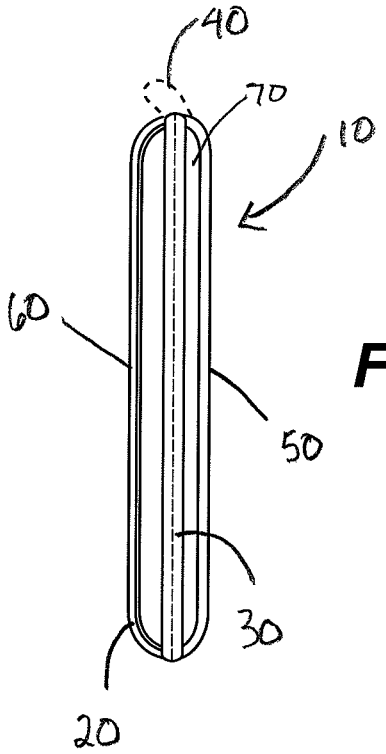
FIG. 3 is a bottom view of an eyewear case having a soft and flexible bag attached to a cover, the cover having a bottom flap in an open position and a top flap in a closed position and the bag extended out of the cover for use in accordance with one embodiment of the present invention.
Figure 4:
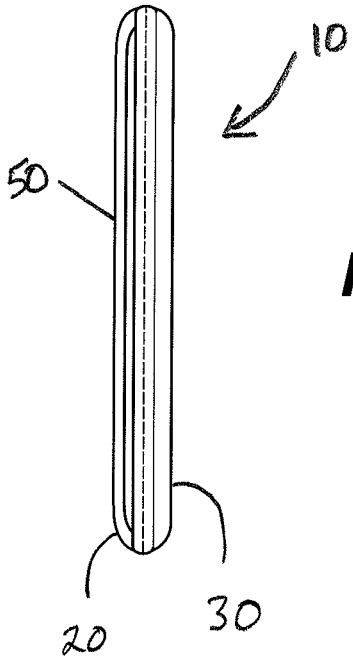
FIG. 4 is a bottom view of an eyewear case having a soft and flexible bag attached to a cover, the cover having a bottom flap in an open position and a top flap in an open position and the bag extended out of the cover for use in accordance with one embodiment of the present invention.

Referring now to FIGS. 1-4 are shown a top and bottom view of a storage case, including an eyewear case, in accordance with one embodiment of the present invention. The case 10 has a cover 20 attached to a bag 30. The case also has an optional attachment member 40. In FIG. 1, the top view of the case shows the cover having a top flap 50 and a bottom flap 60. The bottom flap has been oriented to create an opening 70 in the bottom of the cover and the bag is extended out of such opening. As FIG. 1 is a top view, the bag and cover opening are not shown. However, they are shown in FIG. 3, which is a bottom view of the case. As a result of the opening of the bottom flap, it is oriented onto the back of the cover while the top flap 50 remains on the front of the cover. In FIG. 2, the top flap has been oriented to expose an opening 80 in the bag and now is oriented onto the back of the cover and thus overlaps the bottom flap. The bag opening 80 may now be used to insert or with draw eyewear or other objects/devices from the bag, and the front of the bag is completely exposed out of the cover while a portion of the back of the bag is covered by the inverted top flap of the cover. A bottom view of the case with the top flap oriented, or articulated, into an open position to expose the bag opening is shown in FIG. 4.

Figure 5:
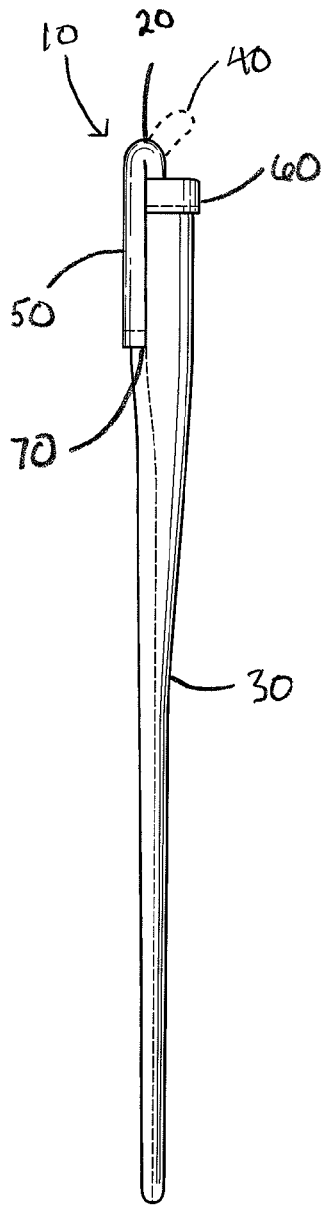
FIG. 5 is a side view of an eyewear case having a soft and flexible bag attached to a cover, the cover having a bottom flap in an open position and a top flap in a closed position and the bag extended out of the cover for use in accordance with one embodiment of the present invention.
Figure 6:
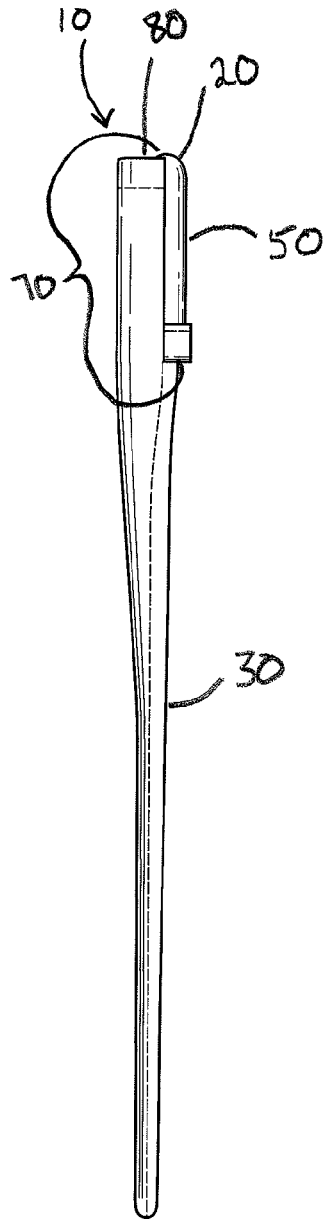
FIG. 6 is a side view of an eyewear case having a soft and flexible bag attached to a cover, the cover having a bottom flap in an open position and a top flap in an open position and the bag extended out of the cover for use in accordance with one embodiment of the present invention.
Figure 7:
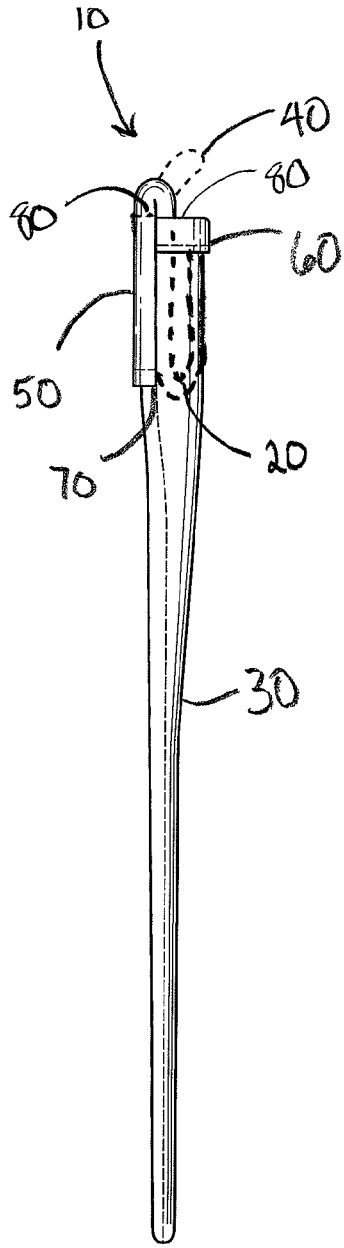
FIG. 7 is a side view of an eyewear case having a soft and flexible bag attached to a cover, the cover having a bottom flap in an open position and a top flap in an closed position, the bag extended out of the cover for use, and further showing a portion of the cover extending down inside of the bag in accordance with one embodiment of the present invention.

Referring to FIGS. 5-7 are shown side views of the above-recited embodiment of the present invention. FIG. 5 shows the case 10 having a cover 20 and a bag 30. The cover has an optional attachment member 40. The cover also has a top flap 50 oriented in a closed position so as to cover at least a portion of the front of the bag and a bottom flap 60 oriented in an open position (i.e. inverted from its original position on the front of the cover) to create an opening 70 out of which the bag extends. As a result of being articulated into an open position, the bottom flap is inverted and oriented to the back of the cover and the cover is partially inverted.

As shown in FIG. 6, the top flap 50 of the cover 20 has been inverted to orient it into an open position and expose the opening 80 of the bag 30. In some embodiments the entire bag opening may be exposed and in other embodiments at least a portion of the bag opening may be exposed (i.e. the opening may be partially exposed). As such the top flap now overlaps and covers at least a portion of the bottom flap 60 (not shown). With both flaps inverted, the cover is now fully inverted. In the present embodiment, because the bag 30 is secured along an inside edge of the bottom flap, the top flap also overlaps a portion of the bag. In fact, the top flap covers a portion of the back of the bag and the bottom flap is overlapped and covered by a portion of the bag. Hence, the bag is in between the top and bottom flaps when both flaps are inverted and oriented to the back of the cover. With the cover effectively completely inverted, the cover opening 70 extending from the top portion of the inverted top flap around to the bottom edge of the inverted top flap as shown.

Figure 21:
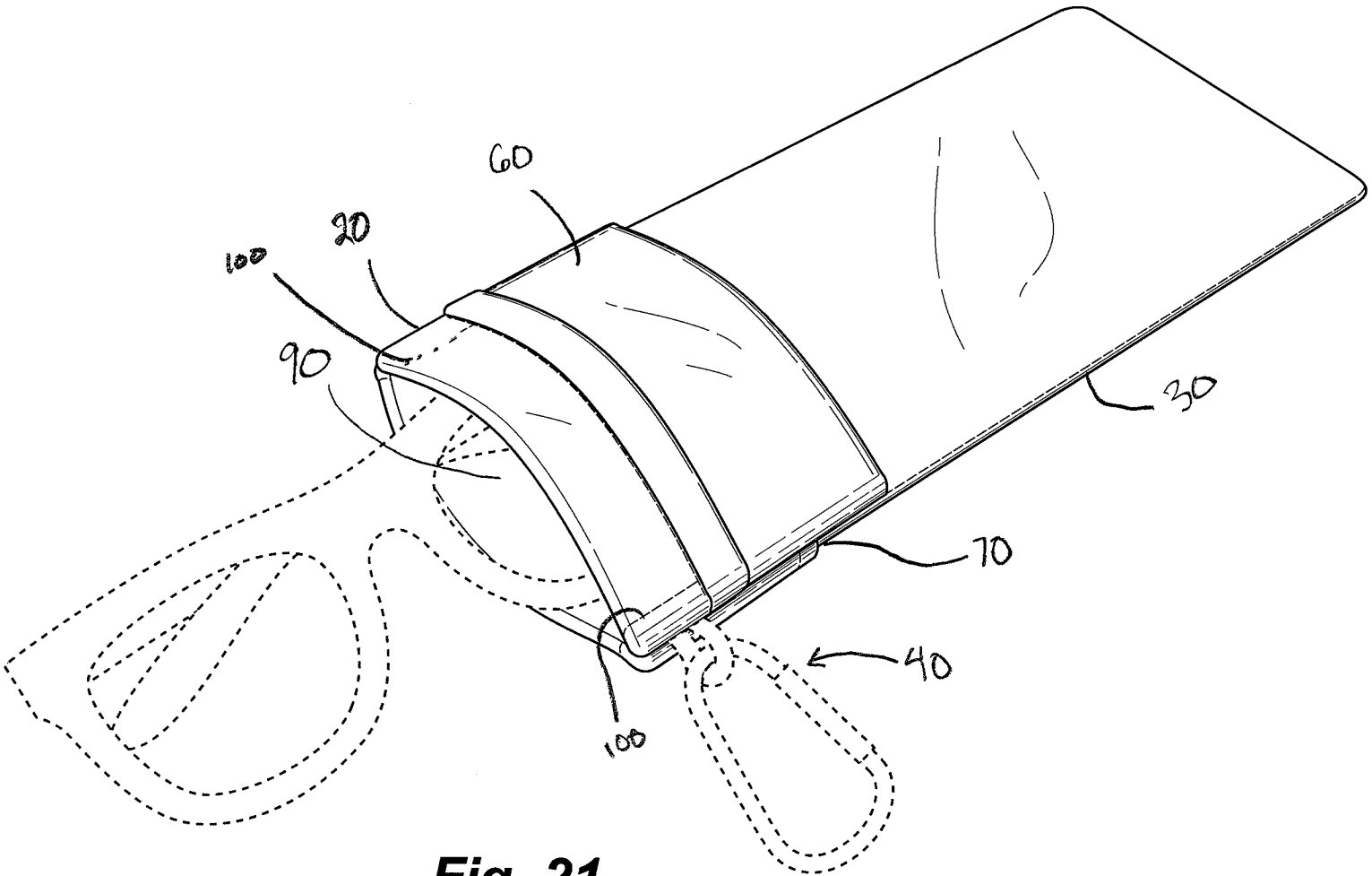
FIG. 21 is a top rear perspective view of an eyewear case as shown in FIG. 18 with a top opening in the cover through which a piece of eyewear is being inserted for storage in the bag.
Figure 23:
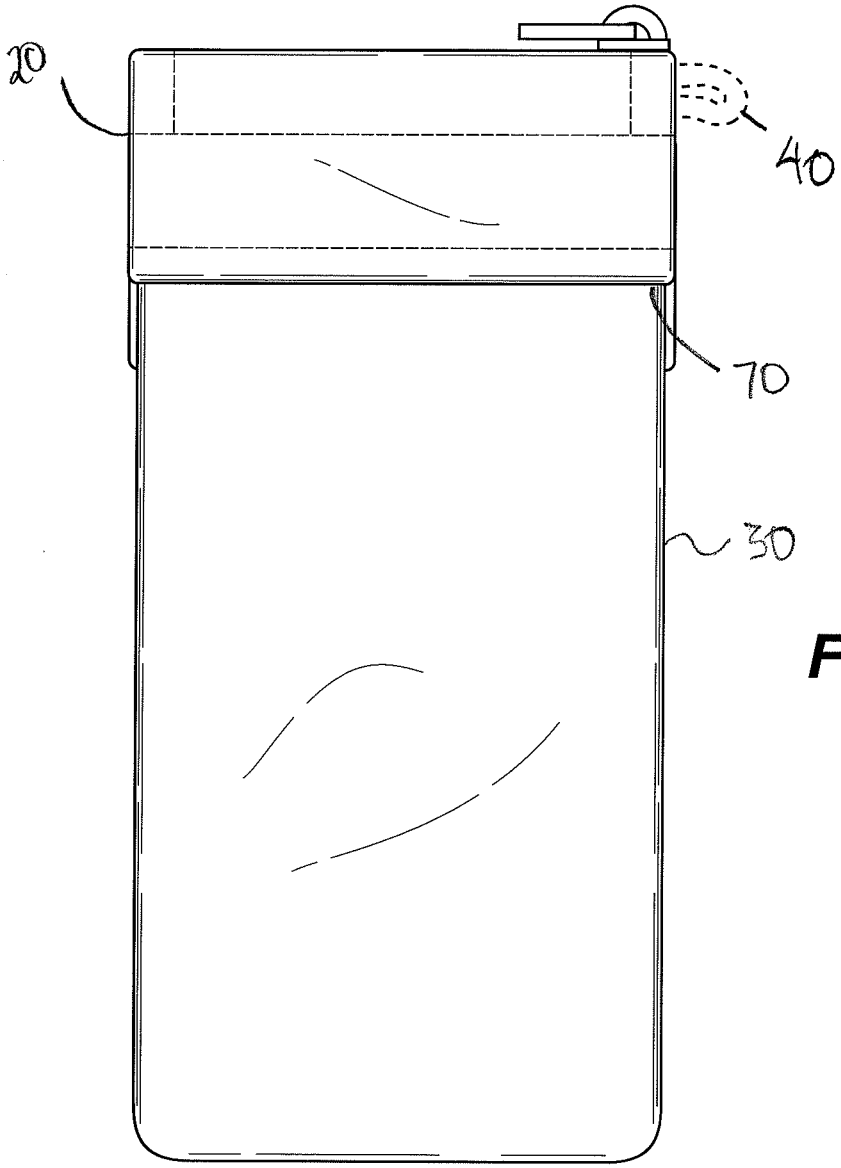
FIG. 23 is a front view of an eyewear case as shown in FIG. 18 with a zipper used to close a top opening of the cover in accordance with one embodiment of the present invention.

Referring to FIG. 7 it can be seen that in the present embodiment, the top 50 of the cover has been oriented (i.e. reverted) to close the opening 80 of the bag 30. In this embodiment, the bag opening remains within, or substantially within the cover 20 when the bag 30 is extended for use out of the cover opening 70, and the cover, (in this embodiment the top flap of the cover) closes the bag opening 80 when the bag is extended out of the cover for use. The use of the cover as a closure for the bag opening also occurs in other embodiments of the present invention and several other embodiments of such are shown and described herein. In some embodiments, rather than inverting the entire cover as shown in FIGS. 5-7 and exposing the bag opening out of the cover, the bag opening may remain within the cover during insertion or retrieval of objects as shown in FIGS. 21 and 23 which will be discussed further.

Figure 8:
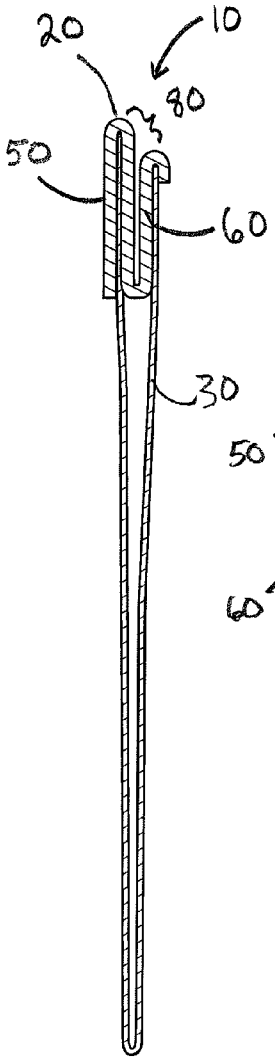
FIG. 8 is a cross-sectional view of an eyewear case having a soft and flexible bag attached to a cover, the cover having a bottom flap in an open position and a top flap in a closed position, the bag extended out of the cover for use, and further showing a portion of the cover extending down inside of the bag in accordance with one embodiment of the present invention.

Referring again to FIG. 7, is shown an embodiment wherein a portion of the cover 20 extends through the bag opening 80 and into the bag when the bag is extended out of the cover for use. This is also shown in FIG. 8, which is a cross sectional view of the present embodiment. As can be seen in FIG. 8, the bag opening 80 extends around the entire circumference of the bag 30 and the bag opening is closed with the cover 20, a portion of the cover extending down into the bag and a portion of the cover extending over a top edge of the bag opening and outside the bag. In effect, the portion of the cover extending down into the bag is the back of the cover and the inverted bottom flap 60, and the portion of the cover on the outside of the bag is the top flap 50. When the top flap is inverted and oriented/articulated into a position where it overlaps and covers a back portion of the bag and the inverted back flap, then the bag opening, or at least a portion thereof, becomes exposed and objects can be inserted or retrieved into or from the bag. Even when in this position, a portion of the cover in this embodiment extends or protrudes through the bag opening and into the bag. In either situation with the top flap open or closed, the amount of cover that extends down into the bag may be varied in order to accommodate a specific design, look, or function. In some aspects, the amount of cover that protrudes through the bag opening and down into the bag may be a majority of the cover. In another aspect, it may be at least half of the cover. In yet another aspect, it may be about two thirds of the cover. In yet another embodiment, the amount may be up to about three quarters of the cover or more. In a further embodiment from 30% to about 70% of the cover may extend down into the bag.

Figure 9:
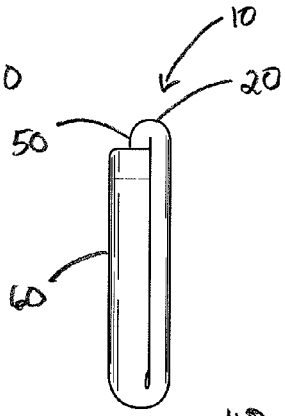
FIG. 9 is a side view of an eyewear case having a soft and flexible bag attached to a cover, the cover having a top flap in a closed position and a bottom flap in a closed position overlapping the top flap, and the bag retracted into the cover member for storage in accordance with one embodiment of the present invention.
Figure 10:
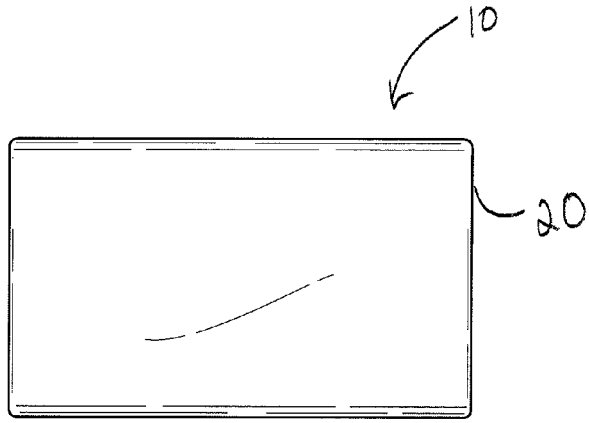
FIG. 10 is a back view of an eyewear case having a soft and flexible bag attached to a cover, the cover having a top flap in a closed position and a bottom flap in a closed position overlapping the top flap, and the bag retracted into the cover member for storage in accordance with one embodiment of the present invention.
Figure 11:
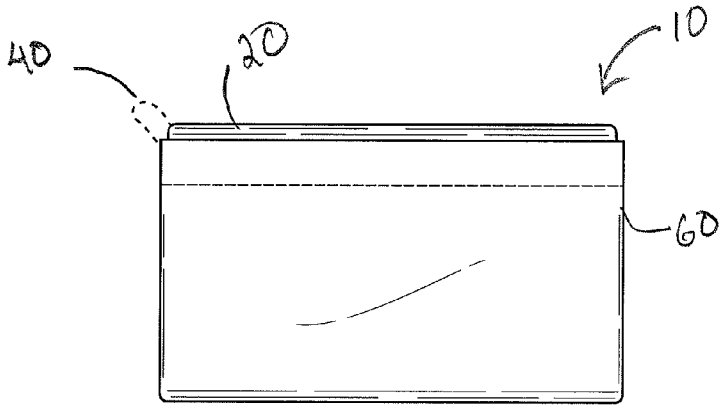
FIG. 11 is a front view of an eyewear case having a soft and flexible bag attached to a cover, the cover having a top flap in a closed position and a bottom flap in a closed position overlapping the top flap, and the bag retracted into the cover member for storage in accordance with one embodiment of the present invention.
Figure 12:
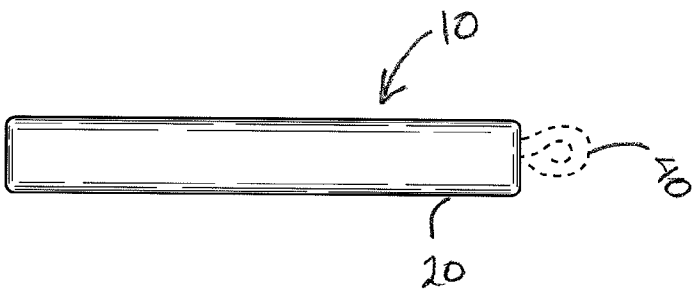
FIG. 12 is a bottom view of an eyewear case having a soft and flexible bag attached to a cover, the cover having a top flap in a closed position and a bottom flap in a closed position overlapping the top flap, and the bag retracted into the cover member for storage in accordance with one embodiment of the present invention.

As shown in FIG. 9, when the bag 30 is retracted into the cover 20, the bottom flap 60 overlaps the top flap 50 and defines a portion of the cavity within the cover. In this regard, the top flap closes the bag opening 80 and defines a portion of the cover opening 70. When the bag is retracted into the cover, the bottom flap is reverted into its original position and overlaps the top flap, thus effectively closing the cover opening out which the bag extended when it was in use. FIGS. 10-12 show back, front, and bottom views of the cover with the bag retracted thereinto in accordance with one embodiment of the present invention.

Figure 13:
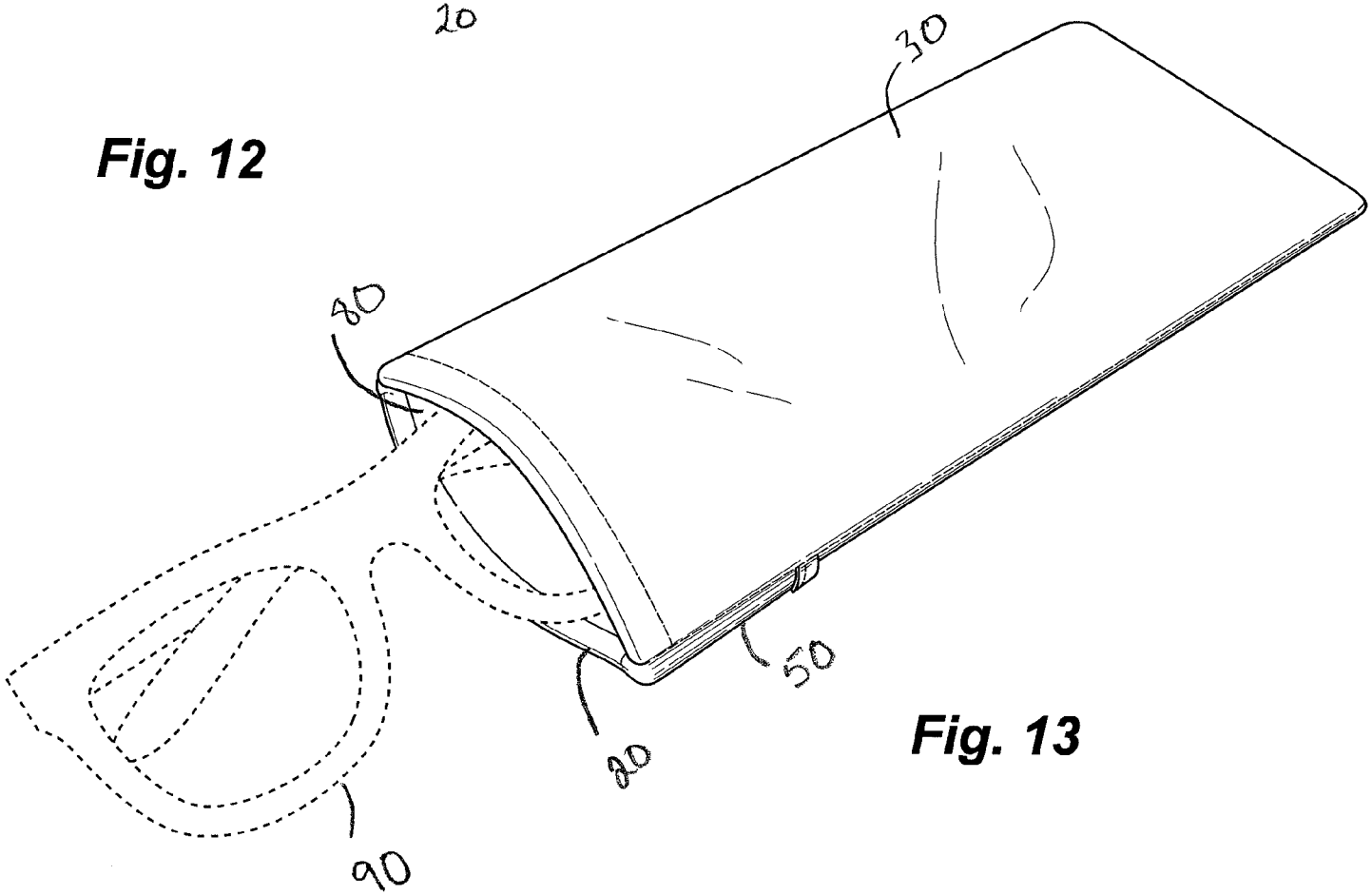
FIG. 13 is a top perspective view of an eyewear case having a soft and flexible bag attached to a cover, the cover having a bottom flap in an open position and a top flap in an open position and the bag extended out of the cover for use, and a piece of eyewear being inserted into the bag through an opening in the bag which is exposed by the open top flap of the cover in accordance with one embodiment of the present invention.

Turning now to FIG. 13 is shown a top perspective view of a storage case 10, including an eyewear case, in accordance with one embodiment of the present invention. As shown, the cover 20 has the bottom flap 60 (not shown) inverted to expose the cover opening and allow the attached bag 30 to extend out of the cover for use. The top flap 50 is also inverted so as to cover at least a portion of the bottom flap and render the cover fully inverted. In this orientation, the bag opening 80, or at least a portion thereof, is exposed and eyewear or other objects and be inserted into or withdrawn from the bag. In this configuration, or in any configuration where the bag is extended out of the cover, the bag may be further used for polishing or cleaning an object, including a scratch sensitive object, as discussed further herein. In one embodiment, a users hand, or portion of the hand or fingers may be inserted into the bag opening in order to control or direct the bag in a cleaning or polishing operation. In this embodiment, the bag becomes much like a mitt and is especially useful for cleaning or polishing large surfaces.

Figure 18:
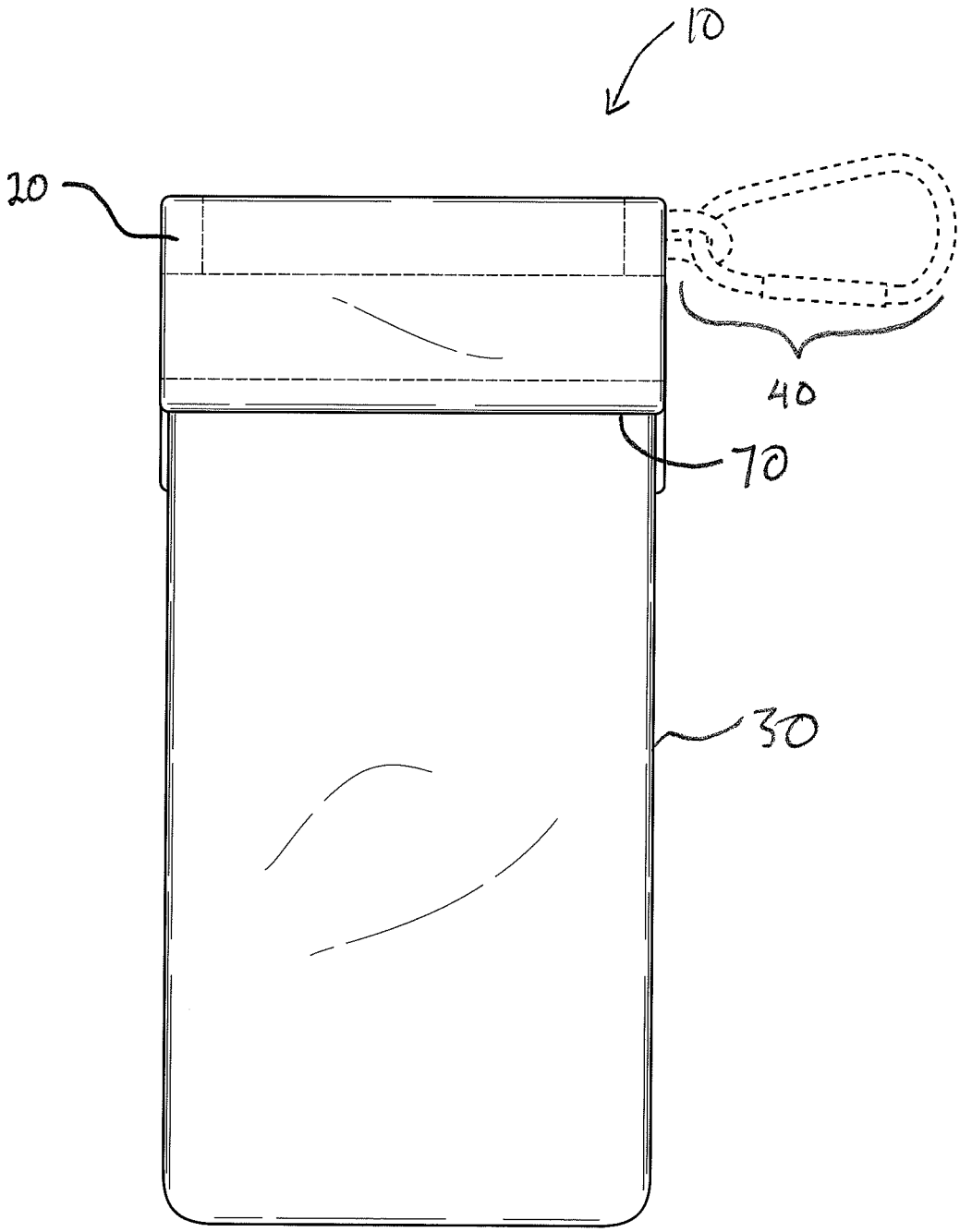
FIG. 18 is a front view of an eyewear case having a cover with a bottom flap in an open position and creating an opening out of which a bag of a soft and flexible material extends in accordance with one embodiment of the present invention.
Figure 19:
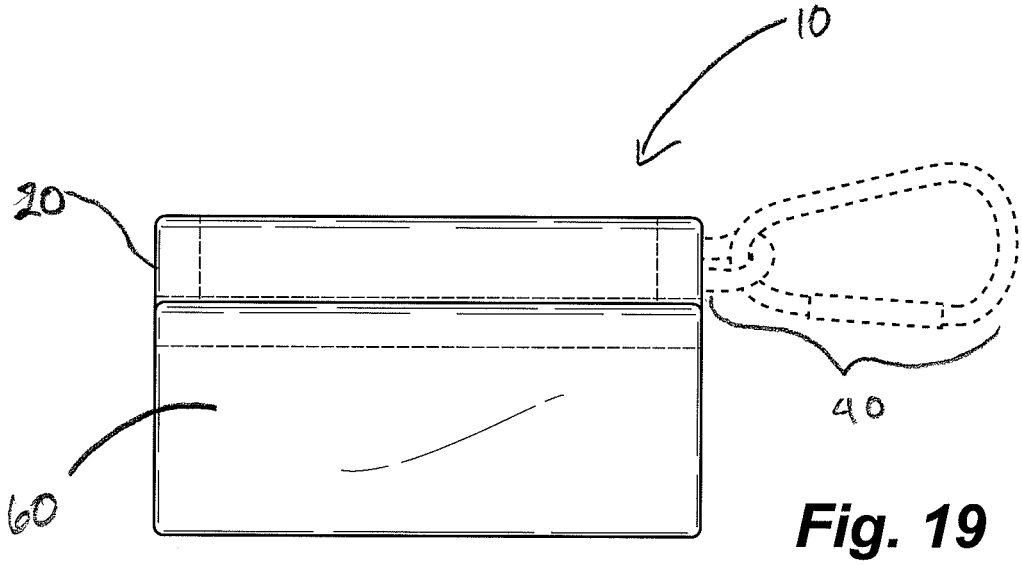
FIG. 19 is a front view of an eyewear case as shown in FIG. 18, with a bottom flap in a closed position, and a bag of a soft and flexible material retracted thereinto for storage in accordance with one embodiment of the present invention.
Figure 20:
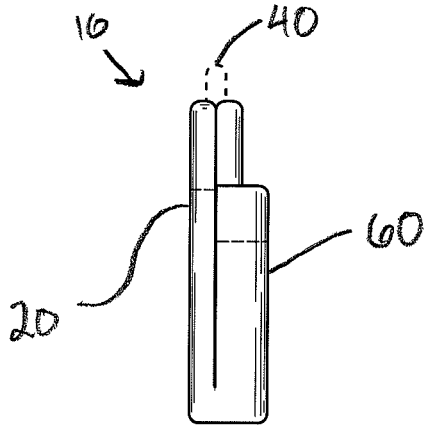
FIG. 20 is a side view of an eyewear case as shown in FIG. 19 in accordance with one embodiment of the present invention.

Referring now to FIG. 18 is shown a front view of a collapsible case in accordance with another embodiment of the present invention. As can be seen, the case 10 has a cover 20 with a bag 30 extended out of the cover through a cover opening 70 and has an optional attachment member 40. The cover opening 70 is created by articulating a bottom flap (not shown) from the front of the cover to the back. FIG. 19 shows a front view of the device pictured in FIG. 18 with the bag retracted into the cover for storage and the cover opening closed. The closure of the cover opening in this case is accomplished by articulating the bottom flap 60 from an open position to a closed position (i.e. reverting the previously inverted flap from the back of the cover back to the front of the cover). FIG. 20 shows a side view of the embodiment of FIG. 19.

Figure 22:
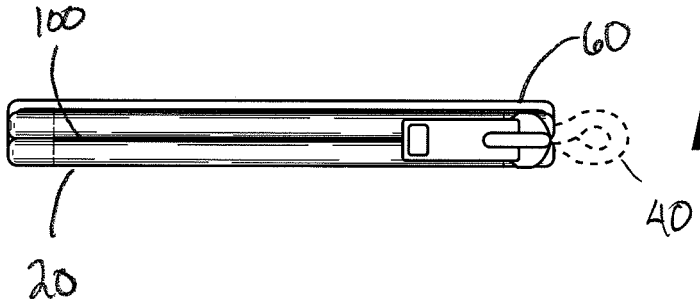
FIG. 22 is a top view of an eyewear case as shown in FIG. 21, with a zipper used to close the top opening of the cover in accordance with one embodiment of the present invention.
Figure 24:
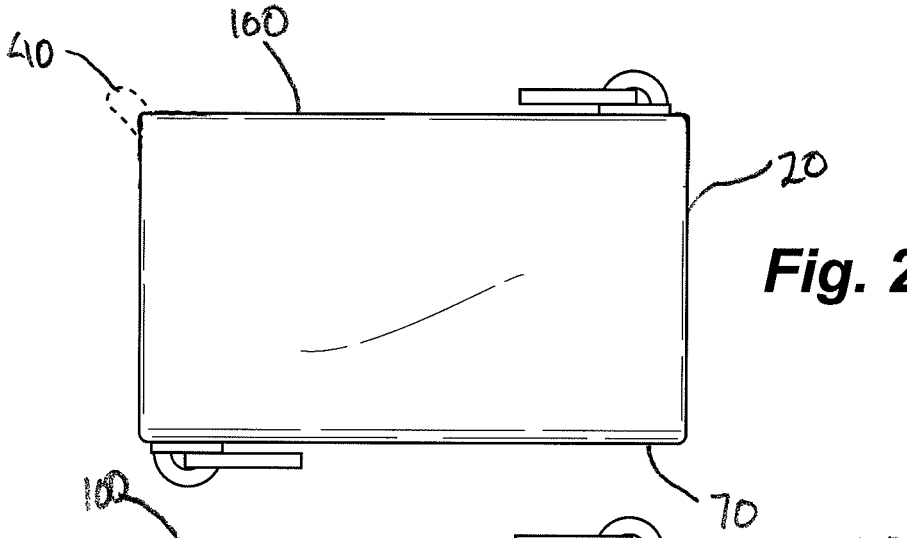
FIG. 24 is a front view of an eyewear case having a cover with a top opening closed by a zipper and a bottom opening closed by a zipper and a bag of a soft and flexible material retracted into the cover for storage in accordance with one embodiment of the present invention.
Figure 25:
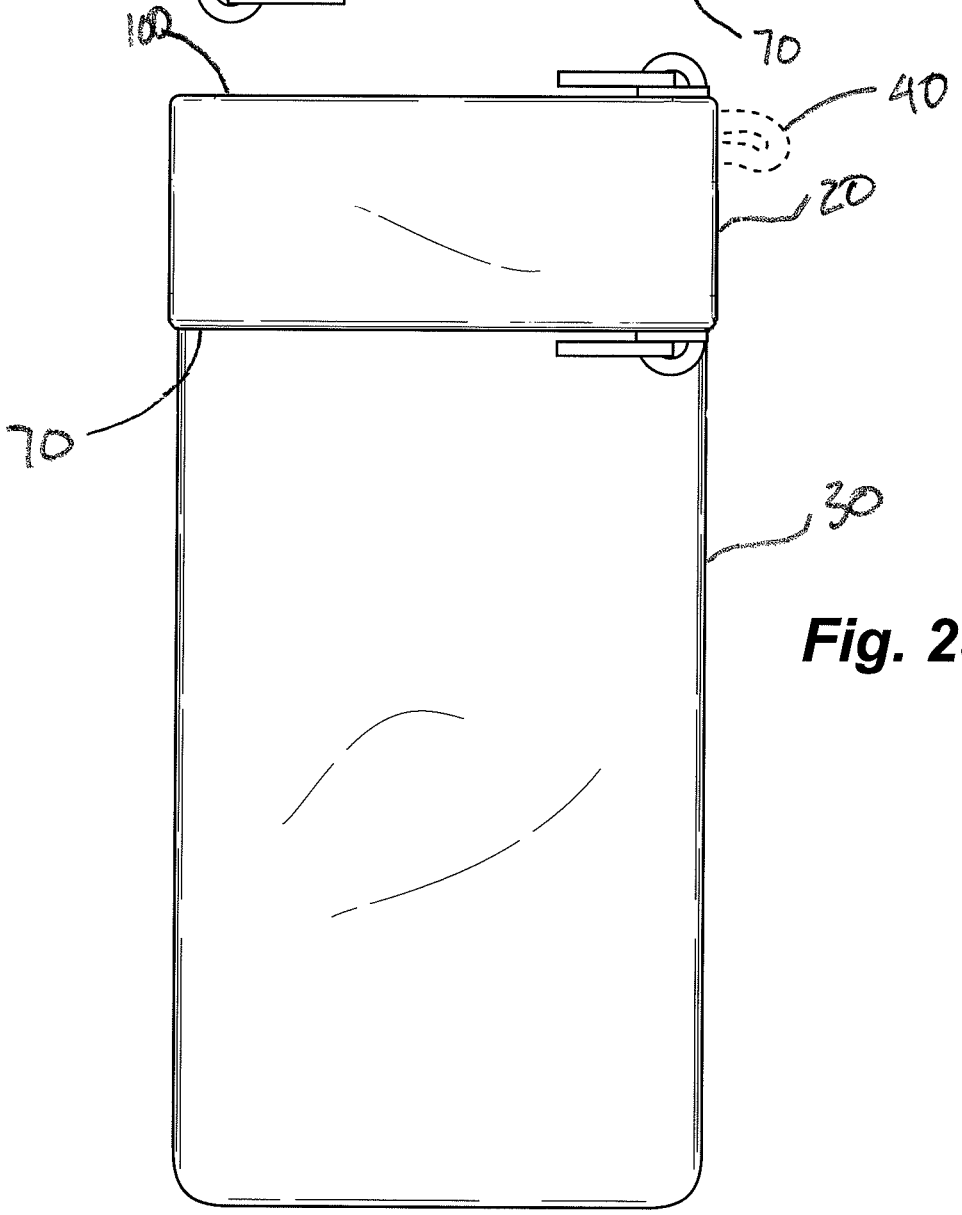
FIG. 25 is a front view of an eyewear case having a cover with a top opening closed by a zipper and a bottom opening through which a bag of a soft and flexible material extends for use, the bottom opening having a zipper closure mechanism which is in an open position in accordance with one embodiment of the present invention.

In FIG. 21, is shown a top rear perspective view of an embodiment of the present invention where the bag opening remains substantially inside the cover during insertion of eyewear or other objects into the bag. Particularly, the bag 30 is extended out of the cover 20 for use through the cover opening 70 which was created by the opening of the bottom flap 60 of the cover as previously described. At the top of the cover is a second opening 90. The bag is attached to the cover along one or more points inside the cover and the bag opening (not shown) remains inside the cavity of the enclosure within the cover at all times, even when inserting or removing eyewear or other objects from the bag. As such, eyewear and other objects pass through the second cover opening and in some embodiments, a portion of the cover, and also through the bag opening when inserted into or withdrawn from the bag. With regards to the cover openings, it is to be understood that a number of closure mechanism may be used to effect closure thereof. In the embodiment of FIGS. 18-21, a strip of semi-rigid material, such as a flexible plastic or metal strip (not shown) is hemmed into a portion of the cover adjacent each side of the second opening 90. Such strips extend along substantially the entire width of the second opening and create a spring effect which holds the opening substantially closed. By placing seams 100 in the cover between the edge of the cover and the end of each metal strip, the second opening may be held completely closed with no space, or substantially no space remaining. The second opening may be opened by a user grasping the edges of the cover near the top and squeezing the edges together. By placing force against the end of each strip of semi-rigid strip of material, the strips can be temporarily bent and thus open the second opening, much like squeezing the opening of some types of coin purses. Once eyewear or objects are inserted or withdrawn from the case, the user then releases the edges of the cover and the semi-rigid strips spring back into their original orientation and effectively close the opening. Additional fastening mechanism that may be used to close either cover opening or both cover openings include without limitation: a flap, a snap, a zipper, a button, a hook and loop fastener, a spring, a hinge, a drawstring, an elastic, a cord, a magnet, a clip, or a combination thereof. In some aspects, one cover opening may be fastened with a flap and the second cover opening is fastened with a pair of springs (i.e. strips of semi-rigid material). In another aspect, one or both cover openings are fastened with hook and loop fasteners. In a further aspect, both cover openings are fastened with flaps. In a further aspect, as shown in FIGS. 24-25, both openings may be fastened with zippers. In yet another aspect, as shown in FIGS. 22 and 23, one opening may be fastened with a flap and the second opening may be fastened with a zipper.

In one embodiment of the present invention the cover may provide an enclosure with a cavity and a single opening through which the bag can be extended or retracted. The bag may be coupled to the cover, for example, by attaching an exterior portion of the bag along its opening to an interior portion of the cover. The cover may effectively close or cover the opening of the bag as the bag opening will be inside the cover when the bag is extended out of the cover opening for use. As the cover can then be inverted or otherwise articulated to expose the bag opening and allow insertion and retrieve of eyewear or other objects into and out of the bag. When not in use, the bag can be collapsed and retracted back through the cover opening and into the cavity of the cover for storage. The cover opening can then be optionally held closed with one or more of the closure or fastener mechanism or devices discussed herein. For example, the embodiments shown in FIGS. 1-13 are depicted as having a bottom flap that closes the cover opening. However, a zipper, button, hook and loop fastener may be suitable used in place of the bottom flap. Further, as shown in FIGS. 1-13, the side edges of the bag can be attached to the inside edges of the cover and in some embodiments, can share a common stitching or seam therewith. However, in an alternative embodiment, the bag may be attached to the inside of the cover horizontally along an edge of the bag opening and the cover can be simply inverted to expose the bag opening.

As mentioned, in some aspects of the invention, the both the bag and cover may be made of soft and flexible materials. In some aspects, the bag and cover may be made of the same, or substantially the same material, and in other aspects, the bag and cover may be made of different materials. In one aspect, the bag may be made of a material that is thinner than the materials of the cover. In another aspect, the cover may be made of an elastomeric material. In a further aspect, the bag maybe made or, or at least include, a material that is sufficiently soft so as to allow cleaning or treatment of objects with a scratch sensitive surface. A variety of fabrics and other materials may serve the aforementioned purposes. In one embodiment, the cover may be of an elastomeric polymer or fabric material, such as neoprene and the like and the bag may be made of a soft and scratch safe material, such as a terry cloth, cotton, polymer material, or microfiber. Use of a neoprene and microfiber combination can be advantageous as the neoprene cover is elastomeric and flexible so as to accommodate articulation and movement when deploying or retracting the bag into the cover, and the microfiber is a thin material which allows easy retraction and storage of a higher volume or surface area of material within the cavity of the enclosure provided by the cover. In one aspect, the cover may be of a rigid or semi-rigid material and may have a cap or other structure that closes the cover opening through which the bag is extended and retracted. In some aspects, the cap or other structure may be coupled to the rigid or semi-rigid cover.

As shown throughout the figures, the cases of the present invention may include an attachment member for attaching the case to another object. Such attachment may be made either when the bag is extended from the cover for use, or when it is retracted into the cover for storage. A wide range of suitable attachment mechanism can be used. In one embodiment, the attachment mechanism may include a cord, a ribbon, a tab, or other structure which forms a loop or provide another suitable point to which a clip, carabineer, lanyard, strap, or other device may be fastened. One significant advantage of including the attachment member is that the case of the present invention may be held about a user's person in a position where it is exposed and ready for use when needed rather than kept in a pocket, bag, or other space. In this way, eyewear and other objects, such as scratch sensitive objects can be used by a user, stored by the user, and safely cleaned and maintained by the user, all without detaching the case from its resident location.

In yet another aspect of the invention, materials that can be suitably imaged may be selected for the cover and bag. Neoprene and microfiber are such materials as well as a number of other textiles or fabrics. Screen printing, sublimating, etc., as well as other know fabric printing techniques may be used in order to provide either the cover or the bag, or both with desired images.

In addition to the devices described herein, the present invention additionally encompasses various methods related to the use of such devices. In one aspect, the present invention provides methods of storing, retrieving, and cleaning or polishing an object which includes providing a storage case as recited herein and orienting, articulating, or manipulating, the cover and bag of the storage case as required in order to accomplish the desired storing, retrieving, or maintaining (i.e. cleaning or polishing) activities. For example, in one aspect, the bag may be extended out of the cover through the cover opening and actuated against a device in order to clean or treat the device and then may be retracted back into the cover for storage once the cleaning or treating activity is complete. As previously mentioned, in some aspects, a users hand, or a portion thereof, such as the fingers may be inserted into the bag in order to facilitate the cleaning or treating activity, especially when large surfaces are being serviced. In another example, the bag may be extended out of the cover and eyewear or other objects inserted into the bag. The bag may then be retracted into the cover once the storage use is complete and the bag has been emptied. The present invention further encompasses methods of making storage cases as recited herein. In one aspect, such a method may include providing a piece of cover material of suitable size and shape to be made into a cover, providing a piece of bag material of suitable size and shape to be made into a bag, forming the cover material into a cover capable of providing an enclosure with a cavity and an opening, forming the bag material into a bag with an opening, and attaching the bag to the cover, such that the bag can be extended out of the cavity through the cover opening for use and retracted back through the cover opening and into the cavity for storage.

The following examples present various methods for making storage cases in accordance with various embodiments of the present invention. Such examples are illustrative only, and no limitation on present invention is meant thereby. Other methods of making the storage cases of the present invention are further encompassed by the present invention.

EXAMPLES

Example 1

Figure 14:
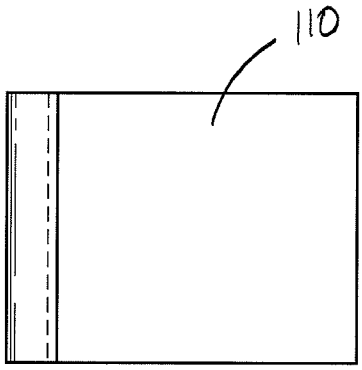
FIG. 14 shows a soft and flexible material to be used as a cover having a hem along one edge as a first step in a process for fabricating an eyewear case in accordance with one embodiment of the present invention.
Figure 15:
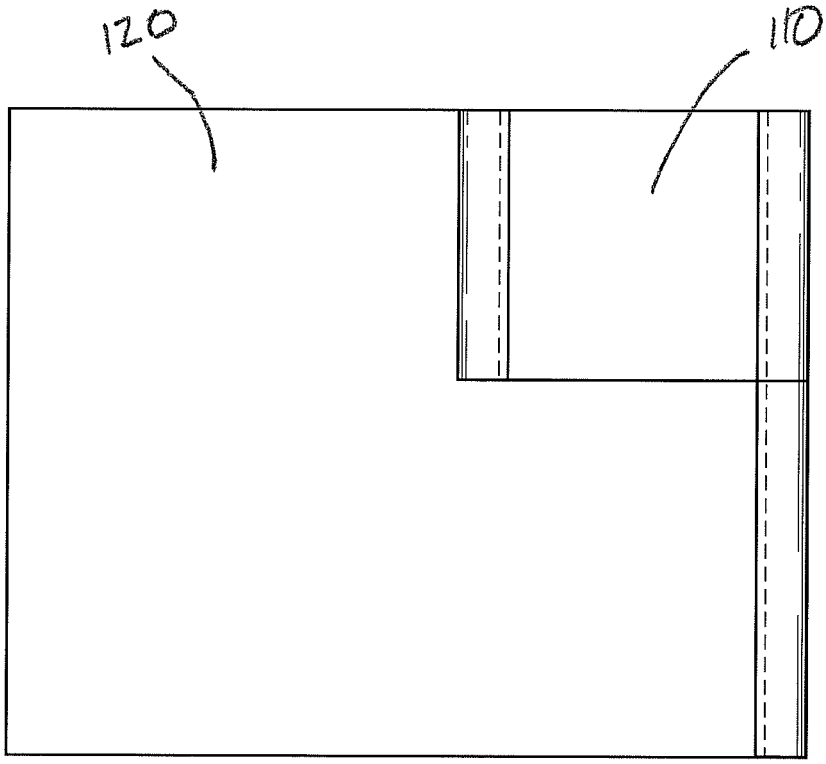
FIG. 15 shows the hemmed cover material of FIG. 14, overlaid on a soft and flexible piece of material to be used for a bag and hemmed in place with said material as a later step of one embodiment of a process for making an eyewear case in accordance with the present invention.
Figure 16:
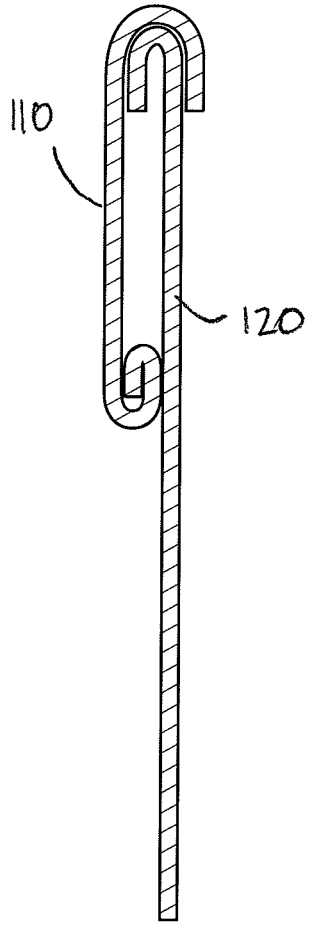
FIG. 16 shows a side view of the cover material and bag material as hemmed together in FIG. 15 in accordance with one embodiment of the invention.
Figure 17:
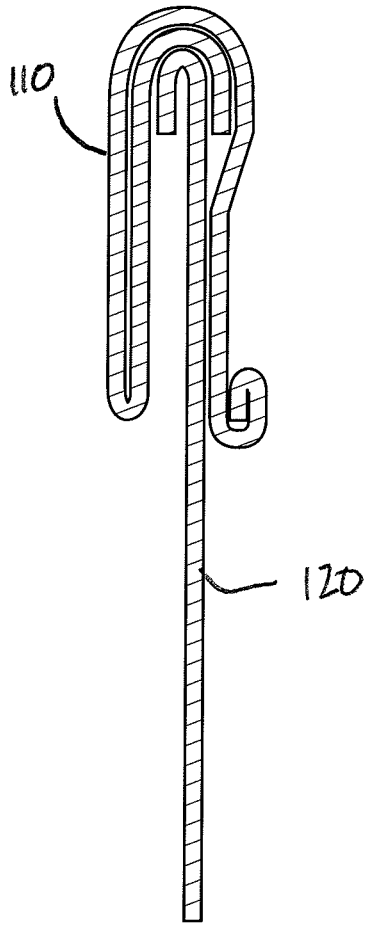
FIG. 17 shows a cover material and bag material oriented so that the cover material is folded over a top edge of the bag material after being hemmed in place there against prior to taking subsequent steps in a method of making a cloth eyewear in accordance with one embodiment of the present invention.

Referring now to FIGS. 14-17 is shown one example of a process for making a storage case in accordance with one embodiment of the present invention. A piece of material 110 which is suitable for use as the cover, such as a neoprene material, is provided and hemmed along one end as shown in FIG. 14. Next, a piece of material 120 that is suitable for use as the bag, such as a microfiber material, is provided and hemmed along one edge. The piece of cover material 110 is laid on the piece of bag material 120 with the hemmed edge of the bag material facing the cover material as shown in FIG. 15. An edge of the piece of cover material is then hemmed over the hemmed edge of the piece of bag material as shown in FIG. 16. The piece of cover material is then folded as desired up over the edge where the cover and bag materials are hemmed together and brought down along the opposite side of the bag material as shown in FIG. 17. At this point, the bag material may be folded in half lengthwise around the portion of cover material extending down by itself on the opposite side of the bag material as shown in FIG. 17. Seams may be made lengthwise down each side of the bag material which extend through all layers of the assembled cover material and bag material. A final seam may be made across the bottom of the bag material to complete the bag enclosure and the edges of the bag may be trimmed if desired. The entire assembly may then be inverted (i.e. turned inside out) to reveal the final case product.

A number of variations of this method may be made, for example, two pieces of bag material may be used rather than a single piece which is folded lengthwise. Additionally, an attachment member may be inserted in between the folds of the piece of cover material at a suitable point and then attached to the device with the same seams attaching the cover material to the bag material.

Example 2

A piece of suitable cover material is provided. The cover material has a straight top edge and a two part bottom edge. Approximately one half of the bottom edge is longer than the other half. Both halves of the bottom edge are hemmed. A piece of suitable bag material is provided and laid on the cover material with the hems facing the bag material. The straight top edge of the cover material is then hemmed over an edge of the bag material. A generous gap is left in this hem. Strips of semi-rigid material, such as metal or plastic strips are then slid into this hem and the longer bottom edge is folded back onto the surface of the cover material to equal the length of the cover material with the shorter bottom edge. The entire assembly is then folded lengthwise so that the cover material is held within the fold of the bag material. Seams are then run lengthwise down each side of the bag and extend through all the layers of the assembled bag and cover materials. A seam is made through the bottom of the bag material to close the end and form a bag. The entire assembly is then inverted, or turned inside out. Stitches between the each edge of the cover and the semi-rigid strips of spring material may then be made if desired to further close the second or top cover opening more fully. An attachment member may be placed at this point or at a prior point within the folds of the cover material. Again, a number of variations to this process may be made, such as inserting the strips of spring material after lengthwise folding.

Example 3

As with Example 1, pieces of suitable cover and bag material are provided of approximately equal width. The cover material is hemmed along one edge. The bag material is laid on the cover material and a hem is created in the other edge of the cover material which folds over and seams the bag material to the cover material. The assembled materials are then folded lengthwise so that the cover material is within the folds of the bag material. Seams are place lengthwise down the edges of the bag material and may optionally extend through the cover material. A bottom seam is run across the bottom of the bag material to close the opening and form a bag. The entire assembly is then inverted (i.e. turned inside out) and zippers are installed on each opening of the cover to provide closure mechanisms for the cover openings. Again, a number of variations from the specific steps of this example may be made.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An eyewear case comprising:

a soft and flexible bag having an opening and an internal space sufficiently sized to receive and store a piece of eyewear; and a soft and flexible cover attached to the bag and providing an enclosure with an opening and cavity sufficiently sized to receive and store the bag when the bag is empty;

wherein the bag extends out of the cavity through the cover opening for use and retracts back through the cover opening and substantially into the cavity for storage;

wherein the cover is confiigured to close the bag opening when the bag is extended out of the cover opening for use; and wherein a portion of the cover protrudes through the bag opening and into the bag when the bag is extended out of the cover for use.

2. The eyewear case of claim 1, wherein the bag opening remains substantially inside the cover.

3. The eyewear case of claim 2, wherein the cover has a second opening allowing insertion of eyewear through the second opening, through the bag opening, and into the bag.

4. The eyewear case of claim 1, wherein the cover orients into a configuration that exposes at least a portion of the bag opening outside the cover during insertion of eyewear into the bag.

5. The eyewear case of claim 4, wherein the configuration is a full cover inversion.

6. The eyewear case of claim 5, wherein the cover at least partially reverts in order to close the exposed portion of the bag opening.

7. The eyewear case of claim 1, further comprising a fastener for closing the cover opening and fastening the cover opening closed.

8. The eyewear case of claim 7, wherein the cover opening is fastened with a flap.

9. The eyewear case of claim 1, wherein a portion of the bag opening remains inside the cavity of the cover when the bag is extended out of the cover for use.

10. The eyewear case of claim 9, wherein the portion of the cover protruding through the bag opening is a majority portion.

11. The eyewear case of claim 9, wherein the portion is at least about two thirds of the cover member.

12. The eyewear case of claim 1, wherein the cover orients into a configuration that exposes at least a portion of the bag opening outside the cover during insertion of eyewear into the bag.

13. The eyewear case of claim 1, wherein the cover opening is closed by a flap and the bag opening is closed by a flap in the cover, said flaps defining at least a portion of the cavity within the cover.

14. The eyewear case of claim 1, wherein the cover and the bag share a common seam along one or more side of the eyewear case.

15. The eyewear case of claim 1, wherein the bag and the cover are substantially different materials.

16. The eyewear case of claim 1, wherein the bag is a material suitable for cleaning or treating a device with a scratch sensitive surface and the cover is an elastomeric material.

17. The eyewear case of claim 1, wherein the bag is microfiber and the cover is neoprene.

18. The eyewear case of claim 1, further comprising an attachment member for attaching the eyewear case to an object.

* * * * *